US010159304B2

(12) United States Patent
Farage

(10) Patent No.: US 10,159,304 B2
(45) Date of Patent: Dec. 25, 2018

(54) FOOTWEAR HAVING PIVOTABLE HEEL

(71) Applicant: Christian B. Farage, Williamsville, NY (US)

(72) Inventor: Christian B. Farage, Williamsville, NY (US)

( * ) Notice: Subject to any disclaimer, the term of this patent is extended or adjusted under 35 U.S.C. 154(b) by 0 days.

(21) Appl. No.: 15/436,318

(22) Filed: Feb. 17, 2017

(65) Prior Publication Data

US 2018/0235314 A1 Aug. 23, 2018

(51) Int. Cl.

| | |
|---|---|
| ***A43B 11/00*** | (2006.01) |
| ***A43B 23/08*** | (2006.01) |
| ***A43B 23/02*** | (2006.01) |

(52) U.S. Cl.

CPC ..... *A43B 11/00* (2013.01); *A43B 23/0245* (2013.01); *A43B 23/088* (2013.01)

(58) Field of Classification Search

CPC ..... A43B 11/00; A43B 11/02; A43B 23/08
USPC ..... 36/138, 105
See application file for complete search history.

(56) References Cited

U.S. PATENT DOCUMENTS

| | | | | |
|---|---|---|---|---|
| 2,815,588 A * | 12/1957 | Ruane | A43B 3/26 | 36/138 |
| 2,920,402 A | 1/1960 | Minera | | |
| 4,924,605 A | 5/1990 | Spademan | | |
| 4,972,613 A | 11/1990 | Loveder | | |
| 5,282,327 A * | 2/1994 | Ogle | A43B 11/00 | 36/105 |
| 6,594,921 B2 | 7/2003 | Laio et al. | | |
| 6,643,954 B2 | 11/2003 | Voswinkel | | |
| 6,938,361 B2 * | 9/2005 | Su | A43B 11/00 | 36/105 |
| 7,059,069 B2 * | 6/2006 | Raluy | A43B 3/12 | 36/105 |

(Continued)

FOREIGN PATENT DOCUMENTS

| | | |
|---|---|---|
| EP | 1059044 A1 | 12/2000 |
| WO | 9203943 A1 | 3/1992 |

(Continued)

*Primary Examiner* — Marie D Bays
(74) *Attorney, Agent, or Firm* — Simpson & Simpson, PLLC

(57) ABSTRACT

A heel portion for a footwear including: a heel assembly having a brace member including a first support member and a second support member, a U-shaped guide fixedly secured to and extending generally perpendicularly from the second support member, and a key having a first engagement member fixedly secured to the first support member, a base member, a locking mechanism fixedly secured to the base member having an activation arm, a locking lug portion including a first lug portion opening, a second lug portion opening and a first engagement lug disposed within the first lug portion opening and adapted to releasably engage the first engagement member, the locking lug portion is connected to the activation arm, a spacer including a first spacer opening and a second spacer opening, the first spacer opening substantially aligned with the first lug portion opening and the second spacer opening substantially aligned with the second lug portion opening, and a spring disposed within the second lug portion opening and the second spacer opening; and, a hinge fixedly secured to the heel assembly and the base member adapted to permit pivotal movement therebetween.

21 Claims, 9 Drawing Sheets

(56) References Cited

U.S. PATENT DOCUMENTS

| | | | | |
|---|---|---|---|---|
| 8,499,474 | B2 | 8/2013 | Kaufman | |
| 8,635,791 | B2 | 1/2014 | Baudouin et al. | |
| 2002/0095823 | A1* | 7/2002 | Laio | A43B 3/24 36/138 |
| 2005/0039348 | A1* | 2/2005 | Raluy | A43B 3/12 36/50.1 |
| 2005/0076540 | A1* | 4/2005 | Su | A43B 11/00 36/105 |
| 2007/0209234 | A1 | 9/2007 | Chou | |
| 2014/0298687 | A1 | 10/2014 | Flinterman et al. | |
| 2015/0047223 | A1 | 2/2015 | Flinterman et al. | |

FOREIGN PATENT DOCUMENTS

| | | | | |
|---|---|---|---|---|
| WO | WO 9203943 | A1 * | 3/1992 | A43B 11/00 |
| WO | 9737556 | A1 | 10/1997 | |
| WO | 2011060316 | A1 | 5/2011 | |

* cited by examiner

FOOTWEAR HAVING PIVOTABLE HEEL

FIELD OF THE INVENTION

The invention broadly relates to footwear, more specifically to footwear for people with reduced dexterity or mobility, and even more particularly to footwear for people with reduced dexterity or mobility having a releasably lockable heel portion.

BACKGROUND OF THE INVENTION

Footwear is donned and removed by most people many times per day. For example, people interact with their footwear while entering and exiting a home, a gym, etc. For most people, the acts of putting on and taking off their footwear is an effortless task which is often overlooked due to its considerable ease. The foregoing applies to a variety of footwear types, e.g., slippers, flip-flops, sneakers, dress shoes and boots. Moreover, a variety of securing means are utilized by the various types of shoes. For example, slippers generally do not require any securing means, while sneakers may include hook and loop fasteners and dress shoes may use conventional laces.

For some people, the acts of putting on and taking off their shoes presents difficulty and may be a source of embarrassment or anxiety. For example, some medical conditions, e.g., arthritis, make the acts a long and sometimes painful process. Other people, e.g., younger children, try to save time by simple slipping on already tied shoes or wedging one shoe against the other to assist with removing a shoe. Still other people are always looking for interesting or trending shoes or shoes styles to wear for pleasure or to attract attention. Such people want different and unique shoes so they stand out as unique.

As can be derived from the variety of devices and methods directed at securing footwear on a person, many means have been contemplated to accomplish the desired end, i.e., a secure, comfortable and convenient fit. Heretofore, tradeoffs between aesthetic appearance and ease of use were required. Thus, there is a need for a new footwear having a device that simplifies the acts of putting on and/or removing the footwear, and that can be used by all types of people. There is a further long-felt need for footwear satisfying the foregoing needs that is easy to manufacture and has a low cost of production. Furthermore, there is a long-felt need for the foregoing device that can be adapted for use in new footwear and that is desirable to people interested in wearing trendy and unique footwear for the attention it commands.

BRIEF SUMMARY OF THE INVENTION

Broadly, the present invention comprises a footwear having a flexible or pivotable heel assembly and a locking mechanism. The pivotable heel assembly is movable between a locked heel position and an unlocked heel position.

In some embodiments, the pivotable heel assembly includes a brace member having first and second support members. The first support member is connected to a base member via a hinge. The first support member includes a key extending therefrom, which key includes engagement members that define engagement member openings. A biasing member, e.g., a leaf or coil spring, is mounted on the base member between the first support member and the base.

In some embodiments, a U-shaped guide is connected to the second support member and is adapted to slide in and out of a recess defined in the top collar of a shoe.

In some embodiments, the key is adapted to be received in a locking mechanism which is connected to the base member. The locking mechanism includes a release arm and has engagement lugs. The locking mechanism includes a locking lug housing and a housing cover through which the release arm extends. The locking mechanism includes a biasing member, e.g., a spring, which forces the release arm to extend from the locking lug housing.

When the engagement members move into contact with the engagement lugs, the lugs move and compress the biasing member within the locking mechanism, until the engagement lugs are aligned with the engagement member openings in the engagement members. Subsequently, the engagement lugs move into the engagement member openings thereby locking the engagement members to the locking lugs. Applying a force in a linear direction to the release arm releases the engagement members from the locking mechanism, thereby releasing the locking mechanism and thus the pivotable heel.

It should be appreciated that the present pivotable heel assembly and locking mechanism may be installed in existing footwear designs at the point of manufacture.

The present invention broadly comprises a heel portion for a footwear including a heel assembly, a base member, a locking mechanism and a hinge. The heel assembly includes a brace member having a first support member and a second support member, a U-shaped guide fixedly secured to and extending generally perpendicularly from the second support member, and a key having a first engagement member fixedly secured to the first support member. The locking mechanism is fixedly secured to the base member and includes an activation arm, a locking lug portion having a first lug portion opening, a second lug portion opening and a first engagement lug disposed within the first lug portion opening and adapted to releasably engage the first engagement member, the locking lug portion is connected to the activation arm, a spacer having a first spacer opening and a second spacer opening, the first spacer opening substantially aligned with the first lug portion opening and the second spacer opening substantially aligned with the second lug portion opening, and a spring disposed within the second lug portion opening and the second spacer opening. The hinge is fixedly secured to the heel assembly and the base member and is adapted to permit pivotal movement therebetween.

Moreover, the present invention also broadly comprises a footwear including a heel assembly, a base member, a locking mechanism, a hinge and a top collar. The heel assembly includes a brace member having a first support member and a second support member, a U-shaped guide fixedly secured to and extending generally perpendicularly from the second support member, and a key having a first engagement member fixedly secured to the first support member. The locking mechanism is fixedly secured to the base member and includes an activation arm, a locking lug portion having a first lug portion opening, a second lug portion opening and a first engagement lug disposed within the first lug portion opening and adapted to releasably engage the first engagement member, the locking lug portion is connected to the activation arm, a spacer having a first spacer opening and a second spacer opening, the first spacer opening substantially aligned with the first lug portion opening and the second spacer opening substantially aligned with the second lug portion opening, and a spring disposed within the second lug portion opening and the second spacer opening. The hinge is fixedly secured to the heel assembly and the base member and is adapted to permit pivotal movement therebetween. The top collar includes a top collar recess adapted to receive the U-shaped guide.

These and other objects and advantages of the present invention will be readily appreciable from the following description of preferred embodiments of the invention and from the accompanying drawings and claims.

BRIEF DESCRIPTION OF THE DRAWINGS

The nature and mode of operation of the present invention will now be more fully described in the following detailed description of the invention taken with the accompanying drawing figures, in which.

DETAILED DESCRIPTION OF THE INVENTION

Figure 1:
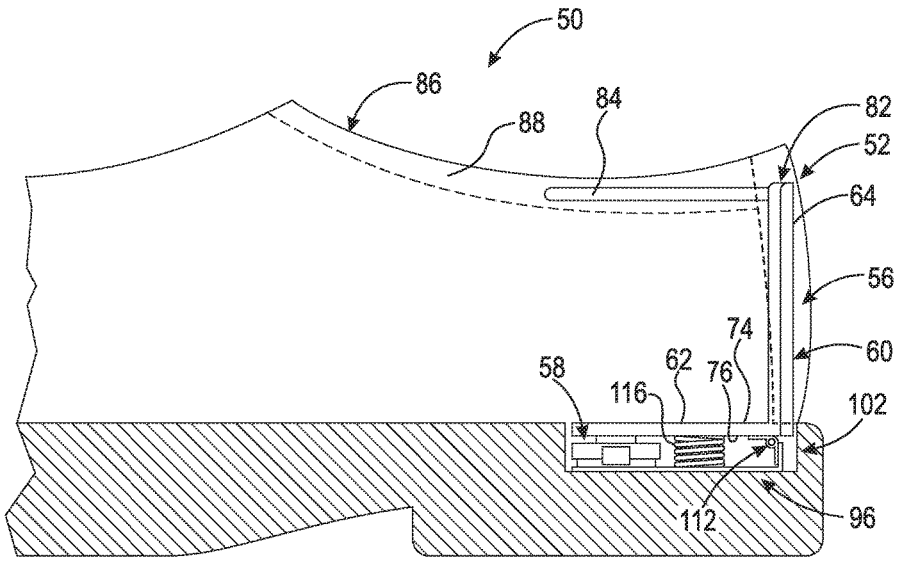
FIG. 1 is a cross sectional view of an embodiment of a present footwear including a pivotable heel assembly in a locked position.
Figure 2:
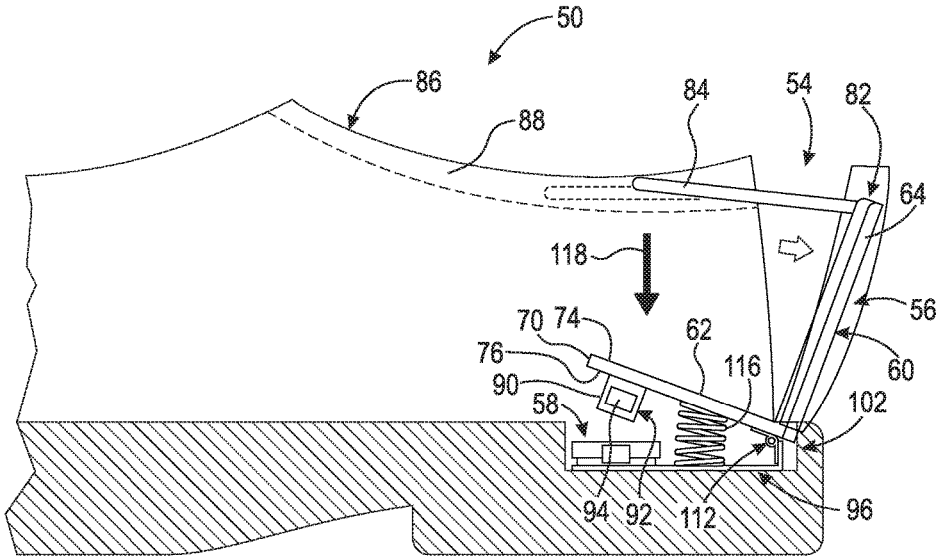
FIG. 2 is a cross sectional view of an embodiment of a present footwear including a pivotable heel assembly in an unlocked position.
Figure 3:
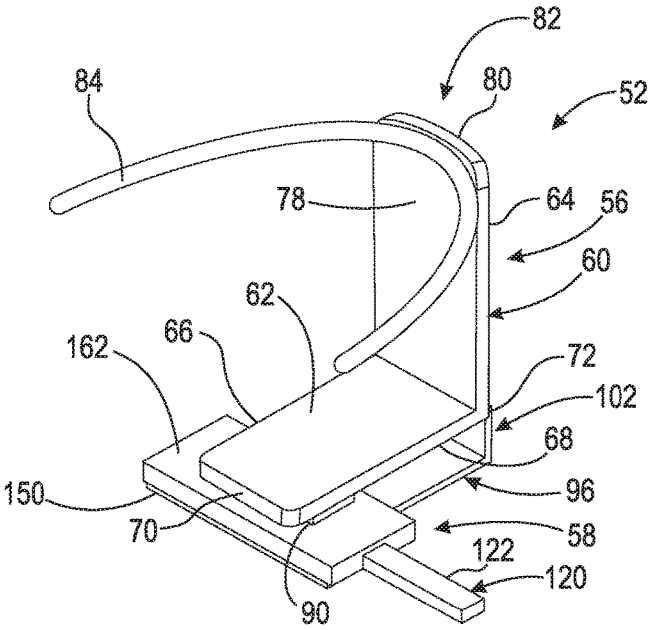
FIG. 3 is a perspective view of an embodiment of a present pivotable heel assembly and locking mechanism arranged in a locked heel position.
Figure 4:
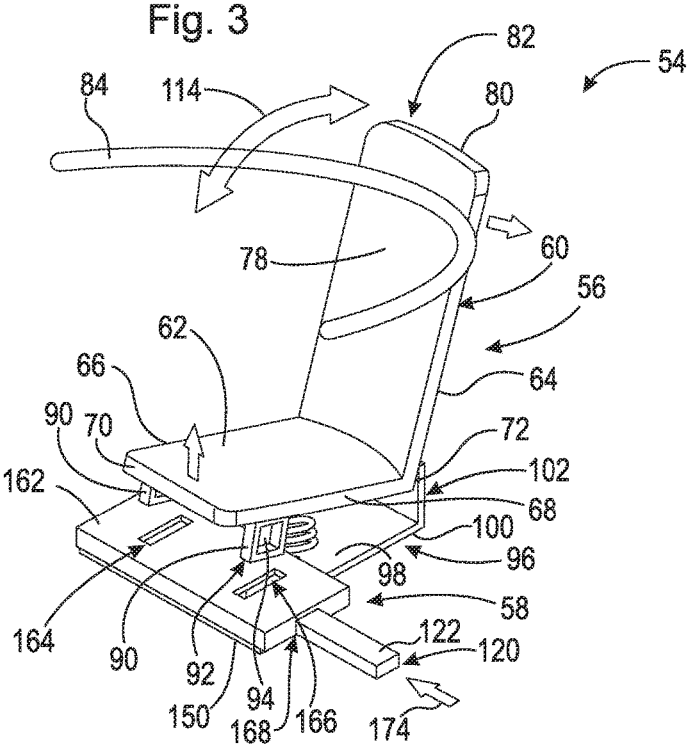
FIG. 4 is a perspective view of an embodiment of a present pivotable heel assembly and locking mechanism arranged in an unlocked heel position.
Figure 5:
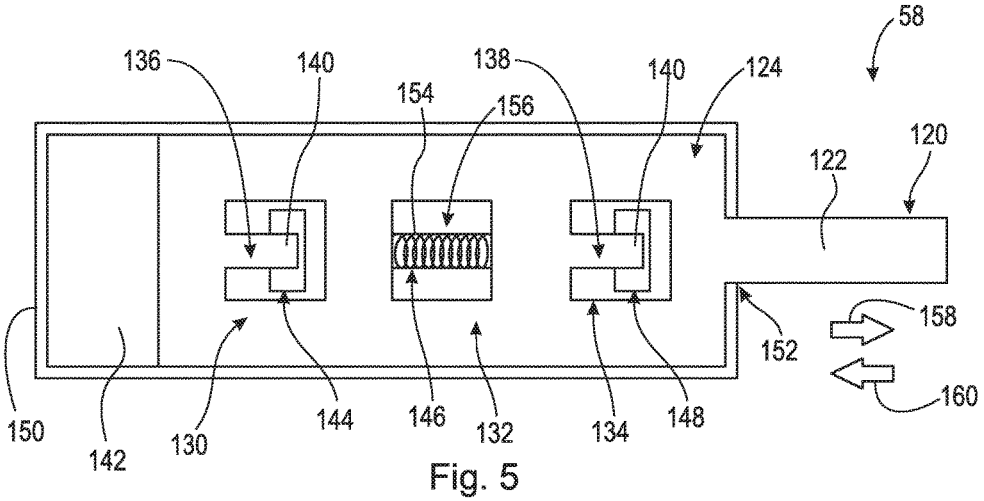
FIG. 5 is a top plan view of an embodiment of a present locking mechanism having the housing cover removed.

At the outset, it should be appreciated that like drawing numbers on different drawing views identify identical, or functionally similar, structural elements of the invention. While the present invention is described with respect to what is presently considered to be the preferred aspects, it is to be understood that the invention as claimed is not limited to the disclosed aspects.

Furthermore, it is understood that this invention is not limited to the particular methodology, materials and modifications described and as such may, of course, vary. It is also understood that the terminology used herein is for the purpose of describing particular aspects only, and is not intended to limit the scope of the present invention, which is limited only by the appended claims.

Unless defined otherwise, all technical and scientific terms used herein have the same meaning as commonly understood to one of ordinary skill in the art to which this invention belongs. It should be appreciated that the term "footwear" is to be broadly construed to include "shoes", "slippers", "sandals" and "boots", and such terms may be used interchangeably as appearing in the specification and claims. Moreover, as used herein, the phrases "comprises at least one of" and "comprising at least one of" in combination with a system or element is intended to mean that the system or element includes one or more of the elements listed after the phrase. For example, a device comprising at least one of: a first element; a second element; and, a third element, is intended to be construed as any one of the following structural arrangements: a device comprising a first element; a device comprising a second element; a device comprising a third element; a device comprising a first element and a second element; a device comprising a first element and a third element; a device comprising a first element, a second element and a third element; or, a device comprising a second element and a third element. A similar interpretation is intended when the phrase "used in at least one of:" is used herein. Furthermore, as used herein, "and/or" is intended to mean a grammatical conjunction used to indicate that one or more of the elements or conditions recited may be included or occur. For example, a device comprising a first element, a second element and/or a third element, is intended to be construed as any one of the following structural arrangements: a device comprising a first element; a device comprising a second element; a device comprising a third element; a device comprising a first element and a second element; a device comprising a first element and a third element; a device comprising a first element, a second element and a third element; or, a device comprising a second element and a third element.

Although any methods, devices or materials similar or equivalent to those described herein can be used in the practice or testing of the invention, the preferred methods, devices, and materials are now described.

Adverting now to the figures, the following is best understood in view of FIGS. 1 through 4. Shoe 50 is depicted in locked heel position 52 in FIG. 1, and depicted in unlocked heel position 54 in FIG. 2. Shoe 50 comprises pivotable heel assembly 56 and locking mechanism 58. Pivotable heel assembly 56 is described in greater detail herebelow.

In some embodiments, pivotable heel assembly 56 comprises brace member 60. Brace member 60 comprises first and second support members 62 and 64, respectively. First and second support members 62 and 64, respectively, are joined together, for example via a weld or adhesive, or alternatively, first and second support members 62 and 64, respectively, can be formed as a single component, e.g., a molded plastic, formed metal, molded/formed semi-rigid or rigid fabric, and combinations thereof.

First support member 62 of brace member 60 has opposed first and second side edges 66 and 68, respectively, joined by opposed third and fourth edges 70 and 72, respectively. First support member 62 further comprises opposed first support member top and bottom surfaces 74 and 76, respectively. In some embodiments, fourth edge 72 is convex so as to mimic the curvature of a heel of a foot (not shown) so that the present shoe 50 is comfortable when worn, or may be customized based on an user's foot and heel shape and size. Second support member 64 of brace 60 extends from fourth edge 72. Second support member 64 comprises opposed concave and convex surfaces 78 and 80, respectively, and further comprises distal end portion 82.

U-shaped guide 84 is fixedly secured to concave surface 78 of second support member 64. It should be appreciated that U-shaped guide 84 may also be attached to convex surface 80 of second support member 64, and in such embodiments, U-shaped guide 84 will extend from second support member 64 in the same direction as depicted in the figures. U-shaped guide 84 is adapted to be received in and removed from top collar 86 of shoe 50. Stitching at the upper rim of shoe 50 forms top collar 86. In some embodiments, top collar 86 is formed from the rim of shoe 50 folded in upon itself and stitched. Top collar 86 defines top collar recess 88 in shoe 50. Collar recess 88 is adapted to receive U-shaped guide 84, such that U-shaped guide 84 is capable of being slid into and out of top collar 86 upon movement of pivotable heel assembly 56 between locked heel position 52 and unlocked heel position 54. In order to facilitate ease of use, in some embodiments, U-shaped guide 84 remains at least partially within top collar 86 throughout its range of motion when moving between locked heel position 52 and unlocked heel position 54.

First support member 62 has opposed first support member top and bottom surfaces 74 and 76, respectively. Key 90 is fixedly secured to and extends from first support member bottom surface 76 of first member 62. Engagement members 92 extend from key 90, and each engagement member 92 comprises an engagement member opening, i.e., opening 94. It should be appreciated that in some embodiments, only a single engagement member 92 is included. Moreover, in some embodiments, key 90 and first support member 62 are formed as a single, contiguous unit. For example, the foregoing components may be formed from plastic or metal as a single unit. Key 90 is adapted for use with locking mechanism 58 as described herebelow.

In some embodiments, pivotable heel assembly 56 further comprises base member 96 having opposed base member top and bottom surfaces 98 and 100, respectively. Base member end wall 102 extends from base member top surface 98. First hinge plate 104 is connected to base member end wall 102, while second hinge plate 106 is connected to first support member bottom surface 76 of support member 62. Hinge pivot 108 extends through barrel 110 formed by first and second hinge plates 104 and 106, respectively. First and second hinge plates 104 and 106, respectively, and hinge pivot 108 collectively form hinge 112 such that brace member 60 is pivotable or movable relative to base member 96, as indicated by bi-directional arrow 114. In some embodiments, hinge 112 is a spring-loaded hinge such that it applies a force to brace member 60 to cause brace member 60 to move in the direction of bi-directional arrow 114.

In some embodiments, pivotable heel assembly 56 further comprises coil spring 116 mounted on first support member bottom surface 76 of first support member 62. Thus, when a load or force, as indicated by unidirectional arrow 118, is applied to support member 62, for example when a person steps into shoe 50, coil spring 116 is compressed.

Locking mechanism 58 is operatively associated with pivotable heel assembly 56. Locking mechanism 58 is mounted on base member top surface 98, such that coil spring 116 is disposed between locking mechanism 58 and hinge 112.

Locking mechanism 58 is also operatively associated with key 90. In some embodiments, locking mechanism 58 comprises release arm 120. Release arm 120 comprises activation arm portion 122 extending to locking lug portion 124, such that activation arm portion 122 extends from locking lug portion 124. Locking lug portion 124 comprises a pair of opposed side members 126 and 128, respectively, and defines first, second and third locking lug portion openings 130, 132 and 134, respectively. First and second engagement lugs 136 and 138, respectively, extend into first and third locking lug openings 130 and 134, respectively. First and second engagement lugs 136 and 138, respectively, extend in a direction toward activation arm portion 122. First and second engagement lugs 136 and 138, respectively, may have a rectangular shaped, or alternatively, may comprise sloped engagement face 140. It should be appreciated that the first and second engagement lugs may comprise other shapes so long as the shape is capable of engaging engagement members 92 of key 90. Locking mechanism 58 also comprises spacer member 142 having first, second and third spacer openings 144, 146 and 148, respectively. Release arm 120 is supported on spacer member 142 such that the first, second and third locking lug portion openings 130, 132 and 134, respectively, are aligned with first, second and third spacer openings 144, 146 and 148, respectively. Locking mechanism 58 further comprises locking mechanism housing 150 that defines opening 152 through which release arm 120 extends. Spacer member 142 is disposed in locking arm housing 150 and release arm 120 is supported on spacer member 142. Spacer member 142 is prevented from moving as it abuts locking mechanism housing 150.

Figure 6:
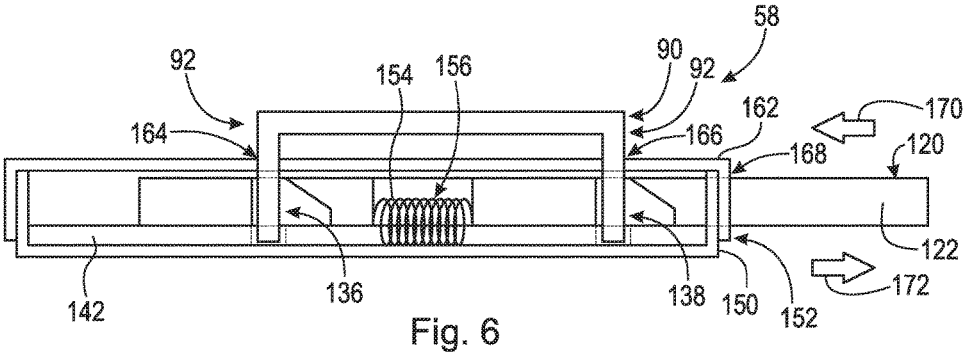
FIG. 6 is a cross sectional view of an embodiment of a present locking mechanism.
Figure 7:
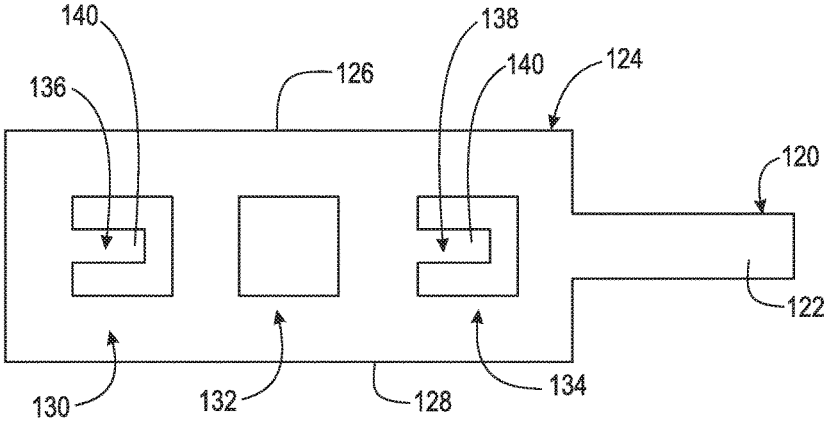
FIG. 7 is a top plan view of an embodiment of a release arm and locking lug portion of a present locking mechanism.
Figure 8:
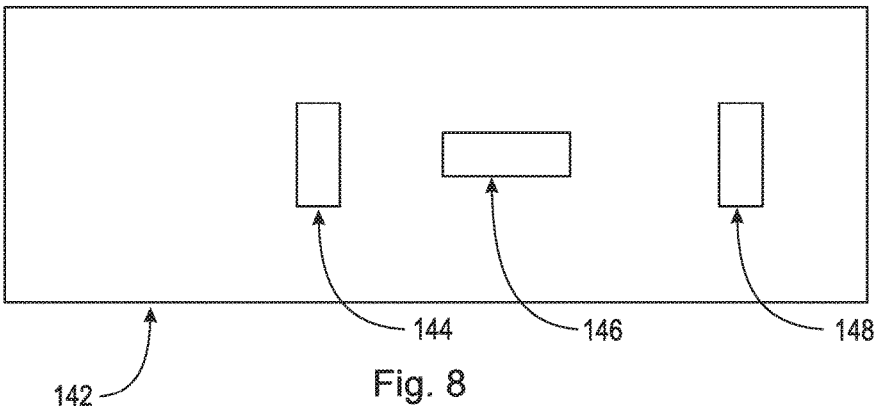
FIG. 8 is a top plan view of an embodiment of a spacer for a present locking mechanism.
Figure 9:
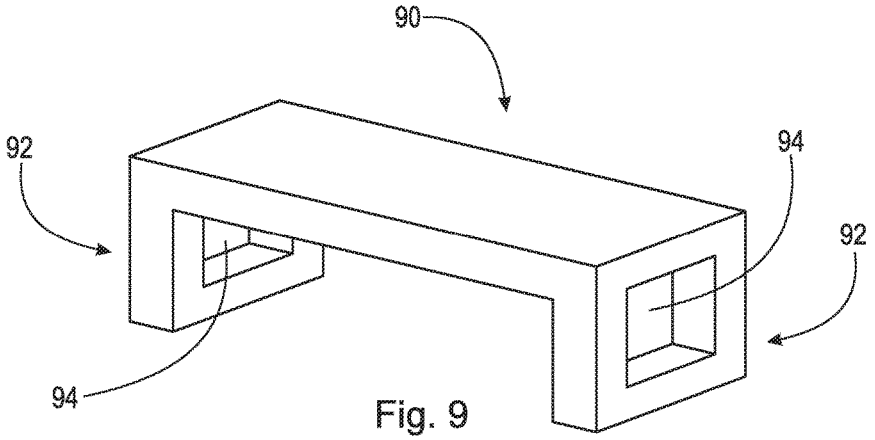
FIG. 9 is a perspective view of an embodiment of a key for a present locking mechanism.
Figure 10:
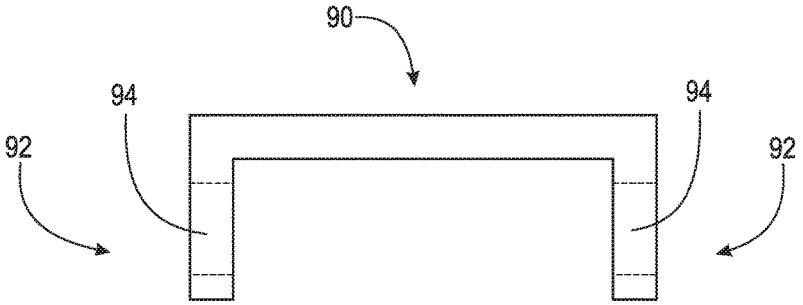
FIG. 10 is a side elevational view of the key of FIG. 9.

Additionally, first and third spacer openings 144 and 148, respectively, in spacer member 142 provide clearance such that key 90 is capable of moving under first and second engagement lugs 136 and 138, respectively. In some embodiments, locking mechanism 58 also comprises locking mechanism spring 154 positioned in second spacer opening 146 and in second locking lug portion opening 132, such that locking mechanism spring 154 abuts against spacer member 142 and release arm 120. Locking mechanism spring 154 is depicted in extended position 156 as indicated by unidirectional arrow 158. When locking mechanism spring 154 is in extended position 156, first and second engagement lugs 136 and 138, respectively, extend over first and third spacer openings 144 and 148, respectively. When a force is applied in the direction of arrow 160, e.g., by applying a force to release arm 120 or by applying a downward force with key 90 (described in greater detail below), locking mechanism spring 154 compresses and first and second engagement lugs 136 and 138, respectively, are moved in a direction away from first and third spacer openings 144 and 148, respectively, such that first and third spacer openings 144 and 148, respectively, are not obstructed by first and second engagement lugs 136 and 138, respectively. When locking mechanism spring 154 is compressed, key 90 may move into or out of first and third spacer openings 144 and 148, respectively. When locking mechanism spring 154 is allowed to expand and key 90 is within first and third spacer openings 144 and 148, respectively, first and second engagement lugs 136 and 138, respectively, engage key 90, thus securing key 90 within locking mechanism 58. FIG. 6 is a cross sectional view of an embodiment of assembled locking mechanism 58 and key 90 held by locking mechanism 58 via first and second engagement lugs 136 and 138, respectively. Application of a force on release arm 120 in the direction of arrow 160 will result in first and second engagement lugs 136 and 138, respectively, moving, thereby releasing key 90.

Housing cover 162 comprises and defines first and second housing cover openings 164 and 166, respectively, and further comprises release arm recess 168. Housing cover 162 is complementarily fits about and is fixedly secured to locking lug housing 150 such that activation arm portion 122 of release arm 120 extends through release arm recess 168.

Figure 11:
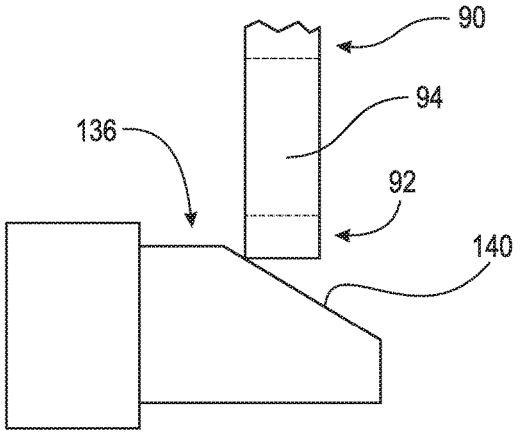
FIG. 11 is a side elevational view of an embodiment of a locking lug and key for a present locking mechanism depicted in an unlocked position.
Figure 12:
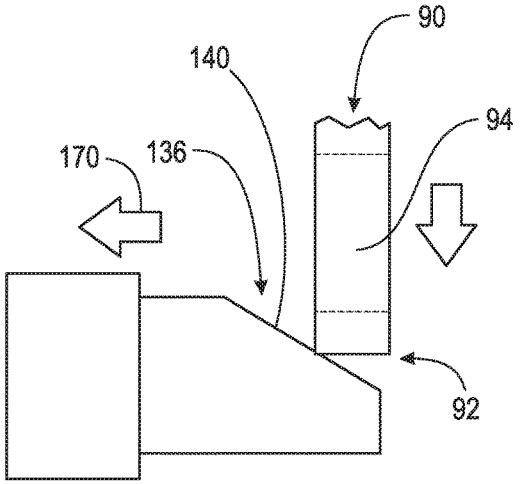
FIG. 12 is side elevational view of an embodiment of a locking lug and key for a present locking mechanism depicted in a partially engaged position.
Figure 13:
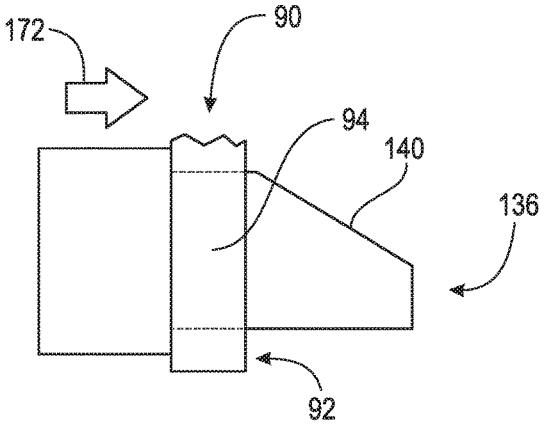
FIG. 13 is side elevational view of an embodiment of a locking lug and key for a present locking mechanism depicted in a locked position.
Figure 14:
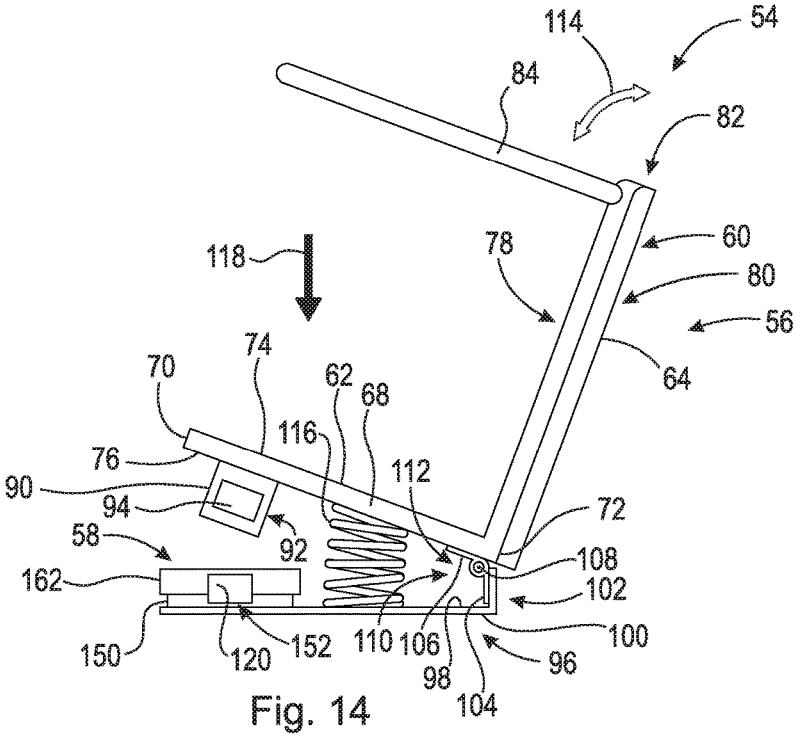
FIG. 14 is a side elevational view of an embodiment of a present pivotable heel assembly and locking mechanism in an unlocked position.
Figure 15:
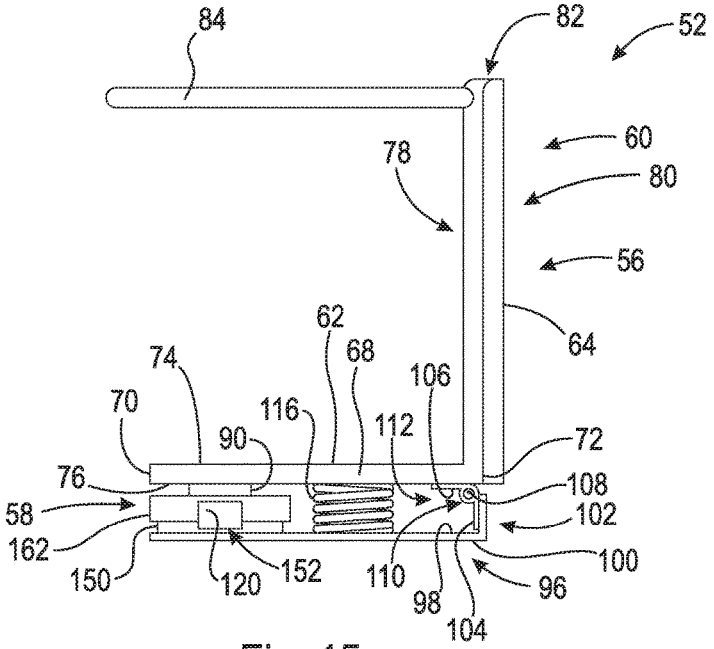
FIG. 15 is a side elevational view of an embodiment of a present pivotable heel assembly and locking mechanism in a locked position.
Figure 16:
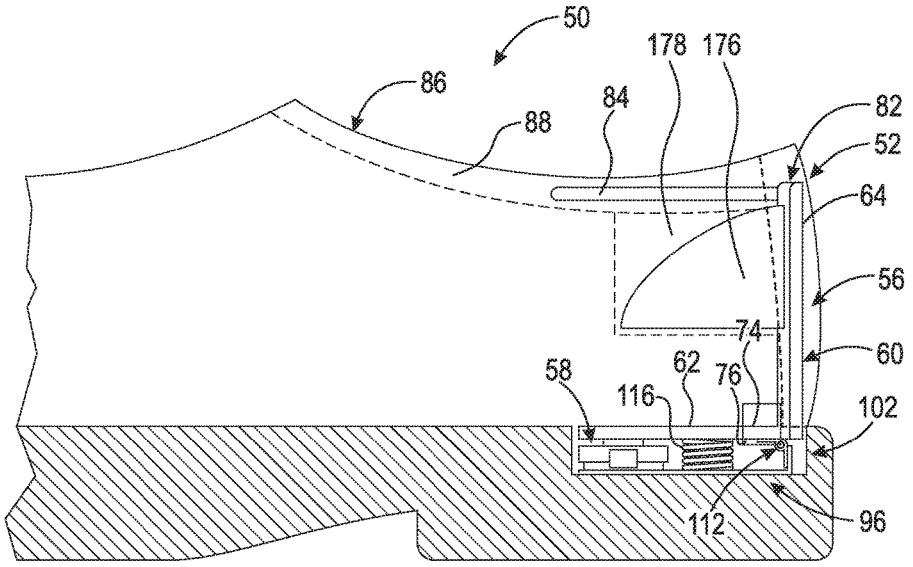
FIG. 16 is a cross sectional view of an embodiment of a present footwear including a pivotable heel assembly in a locked position.
Figure 17:
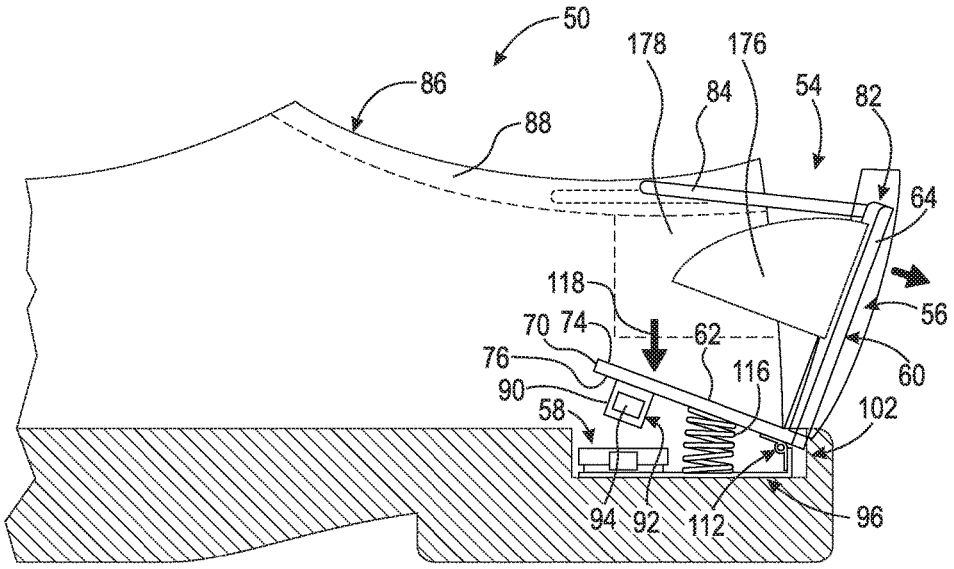
FIG. 17 is a cross sectional view of an embodiment of a present footwear including a pivotable heel assembly in an unlocked position.
Figure 18:
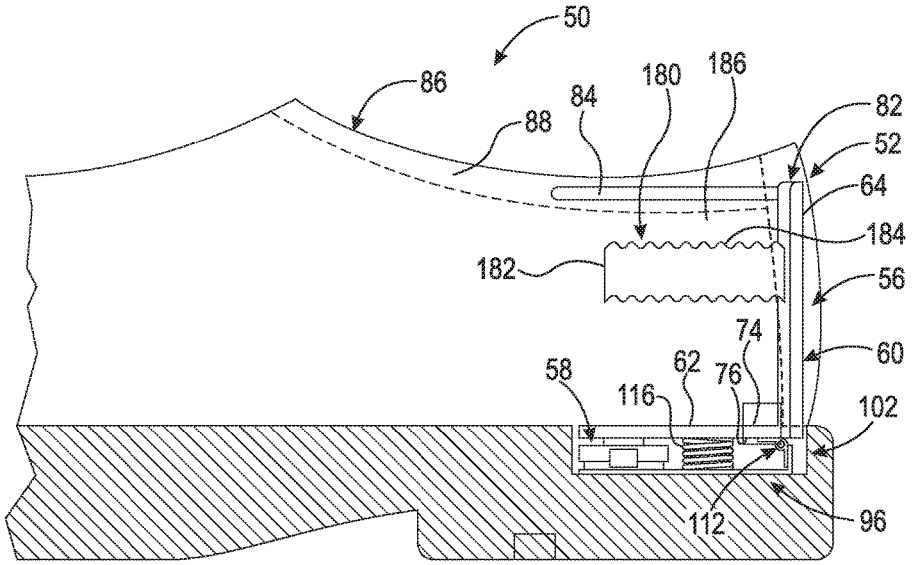
FIG. 18 is a cross sectional view of an embodiment of a present footwear including a pivotable heel assembly in a locked position.
Figure 19:
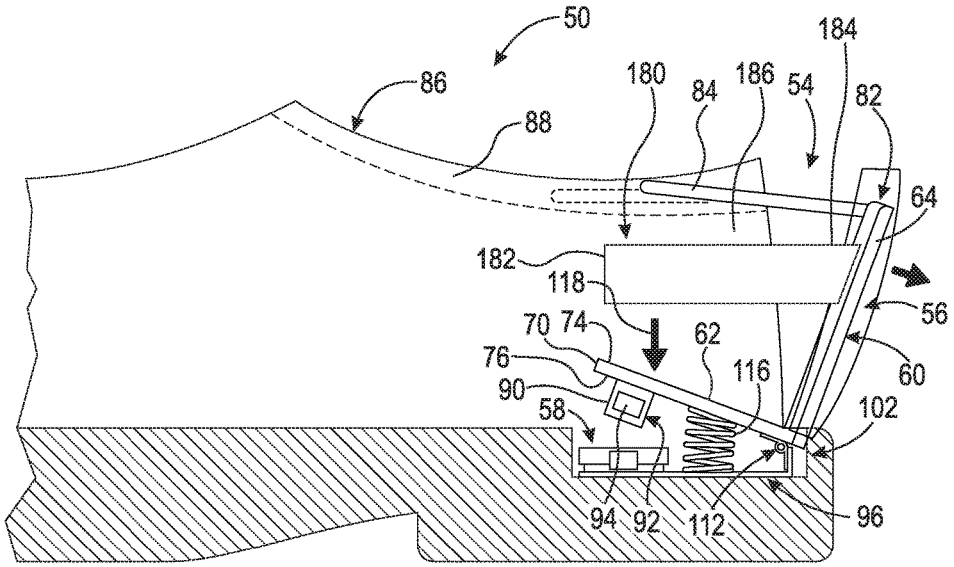
FIG. 19 is a cross sectional view of an embodiment of a present footwear including a pivotable heel assembly in an unlocked position; and, FIG. 20 is a cross sectional view of an embodiment of a present footwear including a pivotable heel assembly in an unlocked position.

FIGS. 11-13 are side elevational views depicting the movement of first engagement lug 136 before, during and after engagement with engagement member 92 of key 90. It should be appreciated that although first engagement lug 136 is depicted as including a linear sloped surface for sloped surface 140, other shapes are also possible, e.g., arcuate, spherical, parabolic, hyperbolic, etc., and such alternate shapes fall within the scope of the claims below. Initially, as engagement member 92 approaches first engagement lug 136, member 92 will contact sloped surface 140. After contact and while member 92 slides along sloped surface 140, locking member spring 154 is compressed, causing first engagement lug 136 and all of locking lug portion 124 to move in the direction of unidirectional arrow 170. Subsequently, once engagement member 92 has cleared first locking lug 136, engagement member opening 94 comes into alignment with first locking lug 136. First locking lug 136 then moves into opening 94 via the force imparted by locking member spring 154 in the direction depicted by unidirectional arrow 172. The foregoing action secures pivotable heel assembly 56 to locking mechanism 58 thereby placing shoe 50 in locked heel position 52.

To release locking mechanism 58 and thus pivotable heel assembly 56, a user applies a force to release arm 120 in the direction of arrow 174, i.e., inwardly, with her free shoe or foot thereby compressing locking member spring 154. As described above, this action releases engagement members 92, and thereby key 90, from locking mechanism 58. Simultaneously, coil spring 116 expands and assists with lifting a user's foot out of shoe 50, U-shaped guide 84 partially slides out of top collar 86. It should be appreciated that a portion of U-shaped guide 84 remains within top collar 86 thereby facilitating the repeated change between locked heel position 52 and unlocked heel position 54. The foregoing permits shoe 50 to retain the appearance of a conventional shoe in locked heel position 52. Thus, most observers will not readily recognize that shoe 50 is different than a conventional shoe, thereby assisting a user of shoe 50 who wishes to conceal that the device is necessary.

When a user puts shoe 50 on, her foot applies a force to coil spring 116 and to engagement members 92 of key 90 thereby forcing members 90 along and past first and second engagement lugs 136 and 138, respectively, causing them to move in the direction of unidirectional arrow 170. After first and second engagement lugs 136 and 138, respectively, are moved out of the way by engagement members 92, first and second engagement lugs 136 and 138, respectively, are immediately moved by locking mechanism spring 154 into engagement member openings 94. Thus, locking mechanism 58 secures pivotable heel assembly 56 in shoe 50 in locked heel position 52.

FIGS. 16-19 depict additional embodiments of a footwear including a presently disclosed pivotable heel assembly. In some embodiments, footwear 50 comprises a U-shaped guide, for example arcuate rod 84 and/or arcuate wall 176. In embodiments including arcuate wall 176, pocket 178 is included on both sides of footwear 50. As pivotable heel assembly 56 moves from locked heel position 52 (See FIG. 16) to unlocked heel position 54 (See FIG. 17), arcuate wall 176 remains at least partially within pockets 178. It should be appreciated that although depicted from a side elevational perspective, arcuate wall 176 comprises a U-shape similar to arcuate rod 84. In other terms, arcuate wall 176 is arranged to fit about a user's heel region similarly as a rear portion of a common footwear. It should be appreciated that footwear 50 may include arcuate rod 84, arcuate wall 176 or both arcuate rod 84 and arcuate wall 176.

In some embodiments, footwear 50 includes a pivotable heel assembly comprising resilient member 180. Resilient member 180 comprises first end 182, a second end (not shown but located on the side of footwear 50 opposite first end 182) and middle portion 184. Middle portion 184 is fixedly secured to and extending from second support member 64. Footwear 50 further comprises first side wall 186 and a second side wall (not shown but located on the side of footwear 50 opposite first side wall 186). First side wall 186 is fixedly secured to first end 182 of resilient member 180, while the second side wall is disposed opposite first side wall 186 and is fixedly secured to the second end of resilient member 180. It should be appreciated that footwear 50 may include arcuate rod 84, arcuate wall 176, resilient member 180 or any combination of two or more of the foregoing structures.

It has been found that including arcuate rod 84, arcuate wall 176 and/or resilient member 180 assists with the use of footwear 50. Arcuate rod 84, arcuate wall 176 and/or resilient member 180 maintain footwear 50 in an open orientation, i.e., a user can insert her foot within footwear 50 without the need to hold open the side walls of footwear 50. In other terms, arcuate rod 84, arcuate wall 176 and/or resilient member 180 maintain the separation of first side wall 186 and the second side wall.

Figure 20:
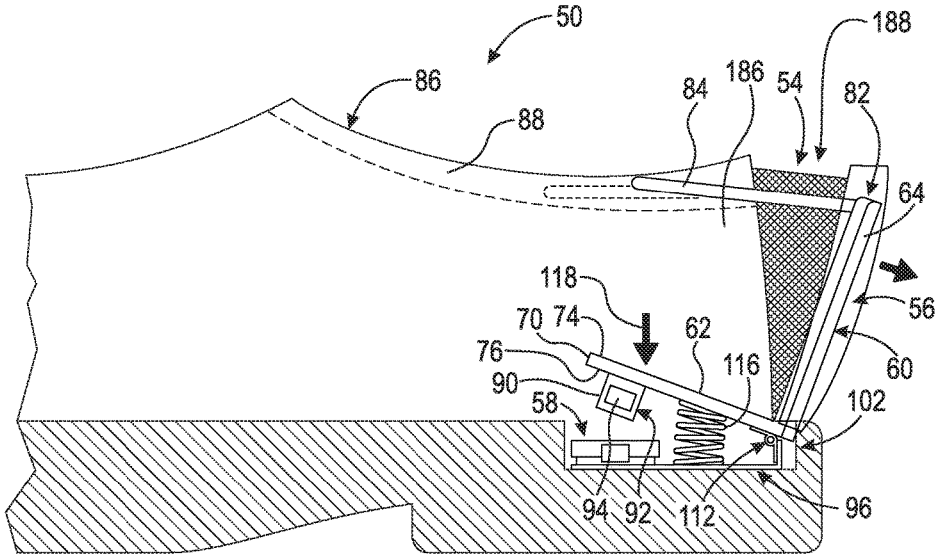

FIG. 20 depicts another embodiment of a footwear including a presently disclosed pivotable heel assembly. In some embodiments, footwear 50 comprises webbing 188 arranged between footwear 50 and pivotable heel assembly 56. In embodiments including webbing 188, webbing 188 is included on both sides of footwear 50. Webbing 188 may be formed from a resilient material, e.g., elastic fibers, or a flexible material, e.g., a canvas cloth. It should be appreciated that webbing 188 in combination with footwear 50 and pivotable heel assembly 56 form an enclosed space for a user's foot. Webbing 188 protects footwear 50 from unwanted entry by objects and debris thereby assisting with maintaining the integrity of footwear 50 and pivotable heel assembly 56.

It should be appreciated that the presently disclosed embodiments of pivotable heel assembly 56 and locking mechanism 58 may be installed in a shoe during its original manufacture, or alternatively, a shoe may be retrofitted with the present device.

The present shoe having a pivotable and lockable heel assembly facilitates putting on and taking off shoes for people that cannot do so without assistance. The pivotable heel assembly may be locked in a closed position and then unlocked by simply pushing the user's feet together. The present shoe and pivotable heel assembly are hands free and provide a step-in and go option for all types of users of footwear.

Thus, it is seen that the objects of the present invention are efficiently obtained, although modifications and changes to the invention should be readily apparent to those having ordinary skill in the art, which modifications are intended to be within the spirit and scope of the invention as claimed. It also is understood that the foregoing description is illustrative of the present invention and should not be considered as limiting. Therefore, other embodiments of the present invention are possible without departing from the spirit and scope of the present invention.

What is claimed is:

1. A heel portion for a footwear comprising:
- a heel assembly comprising:
  - a brace member comprising a first support member and a second support member,
  - a U-shaped guide fixedly secured to and extending generally perpendicularly from the second support member; and,
  - a key comprising a first engagement member fixedly secured to the first support member;
- a base member;
- a locking mechanism fixedly secured to the base member comprising:
  - an activation arm;
  - a locking lug portion comprising a first lug portion opening, a second lug portion opening and a first engagement lug disposed within the first lug portion opening and adapted to releasably engage the first engagement member, the locking lug portion is connected to the activation arm;
  - a spacer comprising a first spacer opening and a second spacer opening, the first spacer opening substantially aligned with the first lug portion opening and the second spacer opening substantially aligned with the second lug portion opening; and,
  - a spring disposed within the second lug portion opening and the second spacer opening; and,
- a hinge fixedly secured to the heel assembly and the base member adapted to permit pivotal movement therebetween.

2. The heel portion for a footwear of claim 1 further comprising:
- a spring adapted to impart a force between the heel assembly and the base member biasing the heel assembly away from the base member.

3. The heel portion for a footwear of claim 1 wherein the second support member comprises a concave surface and the U-shaped guide is fixedly secured to the concave surface.

4. The heel portion for a footwear of claim 1 wherein the second support member comprises a convex surface and the U-shaped guide is fixedly secured to the convex surface.

5. The heel portion for a footwear of claim 1 wherein the key further comprises a second engagement member, the locking lug portion further comprises a third locking lug portion opening and a second engagement lug disposed within the second locking lug portion opening to adapted to releasably engage the second engagement member, and the spacer further comprises a third spacer opening substantially aligned with the third locking lug portion opening.

6. The heel portion for a footwear of claim 5 wherein at least one of the first engagement lug or the second engagement lug comprises a sloped engagement face, an arcuate engagement face, a spherical engagement face, a parabolic engagement face, a hyperbolic engagement face or combinations thereof.

7. The heel portion for a footwear of claim 1 wherein the first engagement lug comprises a sloped engagement face, an arcuate engagement face, a spherical engagement face, a parabolic engagement face, a hyperbolic engagement face or combinations thereof.

8. The heel portion for a footwear of claim 1 wherein the U-shaped guide comprises an arcuate rod and/or an arcuate wall.

9. A footwear comprising:
- a heel assembly comprising:
  - a brace member comprising a first support member and a second support member,
  - a U-shaped guide comprising a first arm and a second arm fixedly secured to and extending generally perpendicularly from the second support member; and,
  - a key comprising a first engagement member fixedly secured to the first support member;
- a base member;
- a locking mechanism fixedly secured to the base member comprising:
  - an activation arm;
  - a locking lug portion comprising a first lug portion opening, a second lug portion opening and a first engagement lug disposed within the first lug portion opening and adapted to releasably engage the first engagement member, the locking lug portion is connected to the activation arm;
  - a spacer comprising a first spacer opening and a second spacer opening, the first spacer opening substantially aligned with the first lug portion opening and the second spacer opening substantially aligned with the second lug portion opening; and,
  - a spring disposed within the second lug portion opening and the second spacer opening; and,
- a hinge fixedly secured to the heel assembly and the base member adapted to permit pivotal movement therebetween.

10. The footwear of claim 9 further comprising:
- a spring adapted to impart a force between the heel assembly and the base member biasing the heel assembly away from the base member.

11. The footwear of claim 9 wherein the second support member comprises a concave surface and the U-shaped guide is fixedly secured to the concave surface.

12. The footwear of claim 9 wherein the second support member comprises a convex surface and the U-shaped guide is fixedly secured to the convex surface.

13. The footwear of claim 9 wherein the key further comprises a second engagement member, the locking lug portion further comprises a third locking lug portion opening and a second engagement lug disposed within the second locking lug portion opening adapted to releasably engage the second engagement member, and the spacer further comprises a third spacer opening substantially aligned with the third locking lug portion opening.

14. The footwear of claim 12 wherein at least one of the first engagement lug or the second engagement lug comprises a sloped engagement face, an arcuate engagement face, a spherical engagement face, a parabolic engagement face, a hyperbolic engagement face or combinations thereof.

15. The footwear of claim 9 wherein the first engagement lug comprises a sloped in engagement face, an arcuate engagement face, a spherical engagement face, a parabolic engagement face, a hyperbolic engagement face or combinations thereof.

16. The footwear of claim 9 wherein the heel assembly is adapted to be positioned in a locked heel position or an unlocked heel position, and the U-shaped guide remains at least partially within the top collar recess when the heel assembly is in the locked heel position and the unlocked heel position.

17. The footwear of claim 9 wherein the U-shaped guide comprises an arcuate rod and/or an arcuate wall.

18. The footwear of claim 17 further comprising:

a top collar comprising a top collar recess adapted to receive the arcuate rod.

19. The footwear of claim 17 further comprising:

a side recess adapted to receive the arcuate wall.

20. The footwear of claim 9 further comprising:

a first side wall;

a second side wall opposite the first side wall; and, a webbing secured between the first side wall and the heel assembly and between the heel assembly and the second side wall.

21. A footwear comprising:

a heel assembly comprising:

a brace member comprising a first support member and a second support member, a resilient member comprising a first end, a second end and a middle portion, the middle portion fixedly secured to and extending from the second support member; and, a key comprising a first engagement member fixedly secured to the first support member;

a base member;

a locking mechanism fixedly secured to the base member comprising:

an activation arm;

a locking lug portion comprising a first lug portion opening, a second lug portion opening and a first engagement lug disposed within the first lug portion opening and adapted to releasably engage the first engagement member, the locking lug portion is connected to the activation arm;

a spacer comprising a first spacer opening and a second spacer opening, the first spacer opening substantially aligned with the first lug portion opening and the second spacer opening substantially aligned with the second lug portion opening; and, a spring disposed within the second lug portion opening and the second spacer opening;

a hinge fixedly secured to the heel assembly and the base member adapted to permit pivotal movement therebetween;

a first side wall fixedly secured to the first end of the resilient member, and, a second side wall disposed opposite the first side wall and fixedly secured to the second end of the resilient member.

* * * * *